United States Patent [19]

Krum

[11] Patent Number: 4,666,780

[45] Date of Patent: May 19, 1987

[54] DIELECTRIC COATING FOR RECORDING MEMBER

[75] Inventor: James L. Krum, St. Paul, Minn.

[73] Assignee: Minnesota Mining and Manufacturing Company, St. Paul, Minn.

[21] Appl. No.: 763,635

[22] Filed: Aug. 8, 1985

[51] Int. Cl.[4] ..... G03G 5/087

[52] U.S. Cl. ..... 428/418; 428/447; 430/96

[58] Field of Search ..... 430/84, 112; 428/412, 428/418, 447

[56] References Cited

U.S. PATENT DOCUMENTS

| | | | |
|---|---|---|---|
| 3,816,840 | 6/1974 | Kotz | 346/74 |
| 3,847,606 | 11/1974 | Schwartz et al. | 96/1.5 |
| 3,912,511 | 10/1975 | Gerace et al. | 96/1.5 |
| 3,946,402 | 3/1976 | Lunde | 346/74 |
| 4,042,749 | 8/1977 | Sandvig | 428/412 |
| 4,049,861 | 9/1977 | Nozari | 428/220 |
| 4,332,851 | 6/1982 | Hosomura et al. | 430/112 |
| 4,402,000 | 8/1983 | Fabel et al. | 346/155 |
| 4,540,652 | 9/1985 | Chuiko et al. | 430/84 |

OTHER PUBLICATIONS

Kotz, Magnetic Stylus Recording, Journal of Applied Photographic Engineering, vol. 7, No. 2, Apr. 1981.

*Primary Examiner*—John L. Goodrow
*Attorney, Agent, or Firm*—Donald M. Sell; James A. Smith; David A. Weinstein

[57] ABSTRACT

A recording member comprising a conductive substrate having a dielectric coating thereon. The recording member is particularly useful with the electrographic recording process and apparatus described in U.S. Pat. No. 3,816,840. The dielectric coating exhibits charge dissipation properties that will allow removal and replacement of toner powder within one operating cycle of the aforementioned recording process, and the surface of the coating is sufficiently durable to allow the recording member to be used repeatedly, e.g., at least about 100,000 cycles, before the conductive substrate needs to be recoated.

16 Claims, 3 Drawing Figures

DIELECTRIC COATING FOR RECORDING MEMBER

BACKGROUND OF THE INVENTION

1. Field of the Invention

The present invention relates to a recording member for the electrographic recording of toner images thereon and to a coating for the recording member, which coating provides the member with electrical, optical, and durability characteristics useful for the recording process.

2. Description of the Prior Art

Kotz, U.S. Pat. No. 3,816,840 discloses an electrographic recording process and apparatus in which a dielectric recording member is arranged between two electrodes. Magnetically adhered to one of the electrodes is electronically conductive toner powder. The toner powder provides an electrically conductive path between the electrode to which it is bound and the adjacent surface of the dielectric member. A voltage is applied to the electrodes for a time and of a magnitude sufficient to generate a force pattern on the toner which enables toner deposition on the recording member in accordance with the force pattern. The force pattern is generated directly on the toner rather than on the recording member, which is passive in the operation of the apparatus disclosed in the patent.

For certain purposes in the practice of the recording process disclosed in U.S. Pat. No. 3,816,840, it is desirable that charge leakage from the recording member be such that a controlled amount of charge is dissipated from the toner deposited thereon, for example, from electrically charged toner applied uniformly to the recording member from an applicator member such as described in U.S. Pat. No. 4,402,000. One benefit of such controlled charge leakage is that the recording member can be re-imaged with no observation of a residue of a previous image pattern that will interfere with the new image on the recording member.

Resistance to mechanical damage, abrasion, and wear are important characteristics for the receptor surface of a recording member employed in a process where an appreciable number of images are required to be applied thereto and removed therefrom. These characteristics of durability can be judged by subjecting a receptor surface to repeated cycles of the process and observing the images produced for signs of catastrophic failure or gradual deterioration. The number of cycles completed while retaining the ability to produce images meeting the acceptance criteria is a measure of the surface's durability.

It is often desirable to apply the toner to a dielectric recording member which has a background color which offers high contrast to the toner powder. For example, if the contrast between toner powder and the recording member to which it is applied were sufficiently high, e.g. 0.6 optical density units, the recorded information could be read directly or indirectly, or even copied by optical means, all with high fidelity and high resolution. Then, the untransferred, unfixed toner powder could be removed from the recording member and new information could be displayed thereon. A system employing a recyclable toner powder could then be designed to optimize the quality of the displayed image without regard to its transfer and fixing properties, or to the cost of depleting the toner powder with each copy.

Anodized aluminum is the current recording member of preference. An aluminum oxide surface that has the appropriate electrical response can be formed on an aluminum substrate by anodization or other conventional means. However, it is well known that such surfaces change over time, particularly when subjected to environments having high relative humidity. This change may adversely affect the electrical characteristics of the aluminum oxide surface. Furthermore, in environments of high relative humidity, aluminum oxide surfaces tend to collect a film of moisture that must be removed by special means to assure a stable electrographic process. Finally, anodized aluminum and other such surfaces do not have the optical properties desirable for certain desirable applications of the process disclosed in the Kotz patent.

A receptor surface for a dielectric recording member, which surface will exhibit sufficient conductivity for the electrographic process, can be prepared by incorporating ionic materials in a dielectric organic resin, such as polyester resin; however, if the desired conductivity is dependent upon the presence of sufficient moisture to cause ionic movement and charge transfer, such a receptor surface will not perform satisfactorily in an environment of low relative humidity.

Other materials for a receptor surface which have appropriate electrical characteristics for use in a rapid cycle electrographic recording process generally are unable to withstand the mechanical abuse resulting from flexing, cycling, and the application and removal of toner powder.

A polyester film bearing an appropriate pigment can provide the desired contrast between recording member and toner powder. However, a polyester film, or a film prepared from another dielectric organic resin, when applied to a conductive grounding surface, will generally not allow charge to flow through it or leak from its surface fast enough to allow removal of one image from the surface of the film and replacement with another image during a commercially acceptable cycle of the electrographic recording device.

Thus, it can be seen that selection of a recording member and dielectric coating thereof for use with a recyclable imaging powder may be constrained by at least three factors:

(1) Electrical properties of the recording member must allow balance between dielectric properties and sufficient charge leakage from the toner so that the toner can be imagewise deposited and thereafter removed from the recording member surface within certain predetermined times (or equivalent distances), such as between an applicator member and the styli array, and/or removal of and replacement of toner powder within one operating cycle of the process;

(2) Durability properties of the recording member must be sufficient in order to allow the process to be economically feasible;

(3) Contrast between the toner powder and the recording member can be specified to be high, e.g. at least 0.6 optical density units.

Although it is relatively simple to provide a recording member that fulfills any one of the three foregoing constraints, satisfaction of all three of them simultaneously has heretofore proved to be extremely difficult.

SUMMARY OF THE INVENTION

This invention involves a recording member suitable for use with the electrographic recording process and apparatus described in Kotz, U.S. Pat. No. 3,816,840. The recording member comprises a conductive substrate having a dielectric coating thereon.

The recording member exhibits charge dissipation properties that will allow removal and replacement of toner powder within one operating cycle of the electrographic recording process described in the aforementioned Kotz patent, e.g. a time period of 2 milliseconds. The surface of the dielectric coating is sufficiently durable to allow the recording member to be used repeatedly before the conductive substrate needs to be recoated, e.g. the coating is able to withstand at least 100,000 cycles of image formation with toner powder and removal thereof. The dielectric coating preferably provides high contrast between toner powder and the recording member, e.g. at least 0.6 optical density units, thus allowing an image formed by said toner powder particles to be read and/or copied by optical means, e.g., cameras, photocells, projection onto a recording surface, while retaining high fidelity and high resolution on the reading surface and/or on copies prepared therefrom. Preferred dielectric coatings are formed from the reaction product of (a) a reactive silane, (b) a metal ester, and, optionally (c) an organic epoxide. The substrate can be formed of any conductive material, e.g. metals, photoconductive materials.

DETAILED DESCRIPTION

Figure 1:
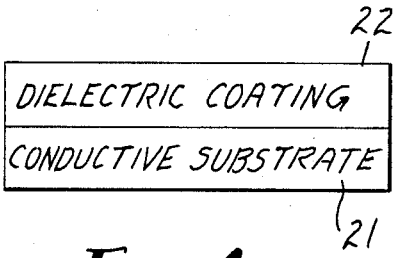
FIG. 1 is a schematic view of one embodiment of the recording member of the present invention.
Figure 2:
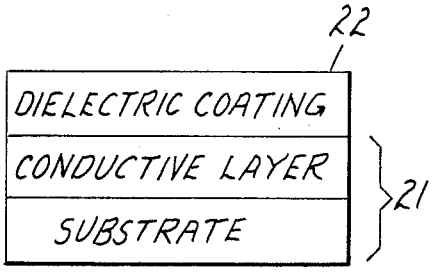
FIG. 2 is a schematic view of another embodiment of the recording member of the present invention.

FIGS. 1 and 2 show alternate embodiments of the recording member of the present invention.

The electronic properties of the dielectric recording member affect the performance of the electrographic recording system described in the Kotz patent, and the limits placed on these properties depend on the specific embodiment. However, the limits in most cases arise from the following considerations.

The electronic capacity of the dielectric recording member must be low enough to allow, in the time interval for image development, sufficient toner potential build-up and sufficient force build-up on the toner positioned in electronic contact with the image receptive surface of the recording member. This capacity is determined by the dielectric constant and the size and configuration of the dielectric recording member with respect to other parts of the circuit. The capacity should be high enough to permit, in conjunction with the rest of the circuit elements, sufficient charge build-up on the external toner particles at the applied voltage chosen for operation.

The resistivity of the dielectric recording member should be sufficiently high to prevent so much charge from flowing off of the toner into the dielectric recording member at such a rate as to reduce the electrical force to a level insufficient to overcome the magnetic force in image areas. The electronic resistivity of the dielectric recording member, in most embodiments of this invention, should be at least about $10^7$ ohm-centimeters. Preferably, its resistivity should be at least 10 times the resistivity of the toner at electric fields comparable to those experienced by the materials in the practice of the invention of U.S. Pat. No. 3,816,840, incorporated herein by reference. The value of resistivity can be determined with an ohmmeter wherein the ohmmeter is connected to two copper bars, both of which bars are placed in contact with the dielectric surface of the composite recording member.

For low voltage operation, which is desirable from an economic and reliability standpoint, it is desirable to have a high electronic capacity for the dielectric recording member. It is more advantageous to achieve this through thin dielectric recording members than through a large dielectric constant coupled with a thick dielectric recording member. The dielectric coating should be sufficiently thick to withstand the voltages applied during the process. A suitable thickness is at least $5\times10^{-6}$ centimeters (500 Angstroms). The thicker the dielectric coating is above the minimum thickness, the greater the voltage necessary to produce a given force for the same dielectric constant. In general, for practical reasons, the thickness of the dielectric coating is kept to a minimum above that at which electrical breakdown would occur, because thicker dielectric coatings result in reduced resolution of the developed pattern.

From the foregoing discussion of limits on electronic properties, it is apparent that thickness of the dielectric coating can have a significant effect on the electrographic recording process. The coating thickness can range from about 0.3 to about 3.0 micrometers, preferably from about 0.3 to about 2.0 micrometers. Coatings having a thickness far in excess of 2.0 micrometers tend to exhibit poorer image resolution or background deposition of toner powder or to require undesirably high voltages, while coatings having a thickness far below 0.3 micrometers tend to lack sufficient durability for a recording member employed in a cyclic electrographic recording process wherein the surface is subjected to repetitive formation and removal of images.

The desired charge/discharge characteristics of a image receptive surface useful in a cyclic embodiment of the electrographic recording process of U.S. Pat. No. 3,816,840 can be defined by a time constant. A time constant is descriptive of the time rate of charge dissipation, that is, the capability of the recording member to support charge, yet allow leakage of the charge, i.e., discharge, to a level consistent with the requirements for cleaning the surface and making it suitable for reimaging within one cycle of the electrographic recording process.

The rate of charge dissipation, sometimes referred to as leakage rate, of a dielectric material, as described in this invention, can be expressed quantitatively as a time constant, $\tau$, of the material, where $\tau=\rho\epsilon_o\epsilon$, and $\tau$=the time constant of the material of the dielectric layer of the recording member, in seconds e=bulk resistivity in ohm-cm of the material of the dielectric layer, $\epsilon$=relative dielectric constant of the material of the dielectric layer (unitless), and $\epsilon_o=8.85\times10^{=14}$ farads/cm, the permitivity of free space (constant of proportionality).

Physically, $\tau$ is the time, in seconds, for an initial amount of charge, Qi, stored on a parallel plate capacitor with the material in question as its dielectric to decay to 1/e of its initial charge, that is, to Qi/e, where e=2.718, the base of the natural logarithm system. For the dielectric materials suitable for this invention, time constants of the order of a print cycle period (i.e. the time interval from the printing of one image to the printing of a subsequent image) are contemplated. In certain embodiments, e.g., such as described in U.S. Pat. No. 4,402,000, the time constants contemplated are of the order of the period beginning with the application of toner to the recording member from the applicator roll and ending with the arrival of the toner at the styli array.

In order to measure empirically the value of $\tau$, the dielectric coating (i.e. the image-receptive surface) is mounted on a conductive drum with its ground plane connected to a suitable ground. The surface is charged, for example, by rotating the drum so that the surface passes beneath a corona source directing charge onto it. By rapidly stopping the image-receptive surface beneath a surface potential measuring device, e.g. a Monroe Iroprobe® Model 144 non-contacting electrostatic voltmeter, the change in surface potential as a function of elapsed time, can be observed. If the measuring device is connected to a plotting recorder, a curve representing measured potential at determined times is produced. Suitable values of $\tau$ can range from several milliseconds to several seconds.

Given a set of process parameters, e.g. stylus voltage, distance between applicator member and styli, printing speed, cycle time between image formation, toner resistivity, determining the time constant of an image-receptive surface, along with the establishment of the thickness of the dielectric coating, will indicate whether the image-receptive surface is useful for a system having the given parameters.

Typical ranges for parameters for dielectric coatings suitable for the present invention are as follows:

Stylus voltage: 5 to 40 V

Cycle time between image formation: several milliseconds to several seconds

Toner resistivity: less than $10^{10}$ ohm-cm at an applied field of about 500 volts/cm Thickness of dielectric coating: $5\times10^{-6}$ cm to $2\times10^{-4}$ cm Time constant of image-receptive surface: several milliseconds to several seconds Other features which may affect the electronic properties of the recording member are more fully described in U.S. Pat. No. 3,816,840.

Although many materials are known to exhibit suitable electronic properties for use in the process of the Kotz patent, relatively few exhibit durability propeties and optical properties that render them useful for certain commercial applications, i.e. those to be viewed optically on the receptor.

The dielectric coating must be sufficiently durable to withstand at least about 100,000 cycles of image formation and removal. It has been discovered that a dielectric coating will exhibit the required level of durability if it exceeds 50 cycles on a Taber abraser Model 503 equipped with a CS-10F wheel at 500 grams load when subjected to test conditions under ASTM D-1044 (1982) before the percentage of light scattered does not change with additional cycles. That the percentage of light scattered remains constant indicates that the coating has been 100% eroded.

The dielectric coating is preferably sufficiently low in reflection optical density so that sufficient contrast between the recording member and toner powder is assured. A suitable level of contrast is at least +0.6 optical density units. If the coating is transparent, the level of contrast between the toner powder and the material comprising the conductive substrate is preferably at least +0.6 optical density units.

The preferred dielectric coating material comprises a polymer prepared from a composition comprising (1) at least one reactive silane, (2) at least one metal ester, and optionally (3) an organic epoxide.

The coating compositions used in the practice of this invention are prepared by simply admixing or blending the ingredients at room temperature (e.g. 25° C.) in a suitable solvent.

Reactive silanes which are useful in this invention are disclosed in Sandvig, U.S. Pat. No. 4,042,749, incorporated herein by reference. These silanes are represented by the formula $$[R^1]_n\text{—Si—}[R^2]_{4-n}$$

In the formula, $R^1$ is selected from the group consisting of $CH_2{=}CH$—, an alkyl group having from 2 to 10 carbon atoms and containing an epoxy group, an alkyl ether epoxide group containing up to 10 carbon atoms, and $$CH_2{=}\underset{\underset{R^4}{|}}{C}-\underset{\underset{O}{\|}}{C}-O-R^3-$$

wherein $R^3$ is an alkylene group having from 1 to 8 carbon atoms, and $R^4$ is hydrogen or an alkyl radical having from 1 to 8 carbon atoms; $R^2$ is an alkoxy or an acetoxy group, and n is a positive integer from 1 to 3.

It is preferred that the silanes be liquids of high purity so that the reaction products are consistent. Purity may be determined by measuring the index of refraction of the silane.

Silanes which are useful in the practice of the present invention include vinyltriethoxy silane ("A-151" commercially available from Union Carbide); vinyltris (2-methoxyethoxy) silane ("A-172" commercially available from Union Carbide); gamma-methacryloxypropyltrimethoxy silane ("A-174" commercially available from Union Carbide); beta-(3,4-epoxycyclohexyl) ethyltrimethoxy silane ("A-186" commercially available from Union Carbide); gamma-glycidoxypropyltrimethoxy silane ("A-187" commercially available from Union Carbide, or "Z-6040" commercially available from Dow Chemical Co.); and vinyltriacetoxy silane. Other useful silanes of the type described are known to the art. The reactive silanes can be utilized alone, or in combination, in the practice of the present invention. The preferred reactive silane is gamma-glycidoxypropyltrimethoxy silane.

The metal esters which are useful in the practice of the present invention can be represented by the formula $M\text{—}(OR)_{x'}$ where M is selected from the group consisting of titanium, aluminum, and zirconium, R is selected from the group consisting of lower alkyl radicals containing from 1 to 8 carbon atoms which are bonded to the oxygen atom, and x is equal to the number of valence bonds of M.

Representative metal esters which have been foumd useful in the practice of the present invention include tetraisopropyl titanate ("Tyzor", commercially available from DuPont); tetrabutyl titanate, tetraethyl titanate, tetra 2-ethylhexyl titanate, aluminum isopropoxide, aluminum n-butoxide, and tetraiosopropyl zirconate. Each of the metals esters can be utilized by itself, or in combination, in the practice of the present invention. Other useful metal esters of the type described are known to the art. The preferred metal ester is tetraisopropyl titanate.

The molar ratio of the metal ester to the reactive silane can be varied depending upon the coating system chosen. For example, in compositions containing the titanium ester and an epoxy-functional silane, the molar ratio of metal ester to silane can range from about 1:0.5 to about 1:7, with the most preferred ratio being 1:4. In compositions containing the titanium ester and acryloxyfunctional silane, the molar ratio can range from about 1:3 to about 1:15, while the preferred molar ratio can range from about 1:3 to about 1:7 with the most preferred ratio being about 1:4. In compositions containing the titanium ester and vinyl-functional silane, a useful molar ratio of metal ester to silane is about 1:4. Other molar ratios of metal ester to reactive silanes are given in Table I.

TABLE I

| | Molar Ratio Metal Ester to Reactive Silane | | |
|---|---|---|---|
| Coating Composition | Useful Range | Preferred Range | Most Preferred Ratio |
| Al—ester/epoxy-functional silane | 1:1 to 1:5 | 1:2 to 1:5 | 1:4 |
| Al—ester/acryloxy-functional silane | 1:1 to 1:10 | 1:2 to 1:5 | 1:4 |
| Zr—ester/epoxy-functional silane | 1:3.5 to 1:4.5 | 1:4 | 1:4 |
| Zr—ester/acryloxy-functional silane | 1:3.5 to 1:4.5 | 1:4 | 1:4 |

The optional epoxide co-reactants useful for preparing the dielectric coating preferably have more than one 1, 2-epoxy group per molecule. It is further preferred that the weight ratio of organic epoxide to reactive silane be in the range of about 10:90 to 25:75. Most preferably, the weight ratio is about 15:85.

Useful epoxide co-reactants include the diglycidyl ethers of polyhydric phenols, glycidyl ethers of novolak resins, glycidyl ethers of aliphatic polyols, and glycidyl ethers containing nitrogen. Preferably the epoxide co-reactant comprises a diglycidyl ether of a polyhydric phenol such as the condensation product of epichlorohydrin and Bisphenol A.

Commercially available solid Bisphenol A type epoxide co-reactants are sold under the trade designations Epon 1002 (a solid diglycidyl ether-bisphenol A resin, epoxy equivalent weight 600–700) and DER 662 (a solid diglycidyl ether-bisphenol A resin, epoxy equivalent weight 575–700). Other useful solid epoxy resins of the diglycidyl ether-Bisphenol A type include Epon 840 (epoxy equivalent weight 330–380, softening point 55°–68° C.), Epon 1001 (epoxy equivalent weight 450–540, softening point 65°–74° C.), Epon 1004 (epoxy equivalent weight 875–1000, softening point 125°–135° C.). Liquid epoxy resins of the diglycidyl ether-Bisphenol A type, which are useful when blended with solid epoxy resins include Epon 834 (epoxy equivalent weight 230–280), Epon 828 (epoxy equivalent weight 185–195), and ERL 2774 (epoxy equivalent weight 180–195). The Epon resins are available from Shell Chemical Co.; the DER resins are available from Dow Chemical Company; the ERL resins are available from Union Carbide. Epoxide co-reactants having higher epoxy equivalent weights can also be used for forming the coating of the present invention.

The glycidyl ethers of novolak resins are characterized by phenyl groups linked by methylene bridges with epoxy groups pendent to the phenyl groups. Commercially available resins are sold under the trade designations DEN-438 (a polyglycidyl ether of phenolformaldehyde novolak, epoxy equivalent weight 176–181) and ECN-1280 (a polyglycidyl ether of orthocresol-formaldehyde novolak, epoxy equivalent weight 230). Commercially available glycidyl ethers of aliphatic polyols include that having the trade designation ERL-4201 (3,4-epoxy-6-methylcyclohexylmethyl-methyl-)adipate, epoxy equivalent weight 220). A commercially available glycidyl ether containing nitrogen is ERL 0510 (triglycidyl para-aminophenol, epoxy equivalent weight 97–101). Another useful epoxy is ERL-4221 (3,4-epoxycyclohexylmethyl-3,4-epoxycyclohexane carboxylate; epoxy equivalent weight 131–143).

Solvents, or other viscosity modifiers, can also be added to adjust the viscosity of the uncured composition. The preferred solvents are esters, such as ethyl acetate, isopropyl acetate, p-amyl acetate, and Cellosolve acetate. Various conventional leveling agents can also be added to the coating composition. These have been found to be useful in producing a high quality optical grade coating. Furthermore, various accelerators can be added to the compositions in order to accelerate the curing process.

In order to reduce the viscosity of the coating compositions, there can be added solvents such as the lower alcohols, lower carboxylic acids, halogenated hydrocarbon solvents, and aromatic solvents. Representative examples of these solvents are ethanol, methanol, tert-butanol, chloroform, methylene chloride, acetic acid, toluene, benzene, xylene, trichloroethane, and 1,2-dichloroethane. The amount of solvent added is dependent upon the particular metal ester used and the coating viscosity desired.

In order to increase the viscosity of the coating compositions, there can be added oligomerized silane in an amount ranging from 1 to 20 percent by weight of the composition. For example, addition to the coating composition of gamma-methacryloxypropyl-trimethoxysilane, prepolymerized by a free radical mechanism at 100° C. for about 20 minutes and diluted to a 50% solution in ethyl alcohol, is useful in increasing the viscosity of the composition.

Leveling agents which level ridges formed in the coating during the coating process are also useful in preparing the coatings of this invention. Leveling agents which are useful in the practice of the invention include "SF-1023", a silicon based surfactant available from General Electric; "FC-430" and "FC-431", fluorocarbon-based surfactants available from Minnesota Mining and Manufacturing Co. Preferably, these leveling agents are present at about 0.3 percent by weight of the coating solution. More or less may be used, if desired. A preferred leveling agent is "SF-1023".

The preferred order of addition of the ingredients is to add the metal ester to the reactive silanes or to the mixture of the reactive silanes, leveling agents, colorants, viscosity modifiers, etc. Substances which accelerate the curing rection preferably are added last.

When the coating composition is prepared with the admixing of solvents, the solution often displays a tendency to foam; therefore, agitation should be minimized. Bubble formation is undesirable because it can lead to discontinuites in the dried coating.

Solvent solution coating compositions are preferred in the practice of the present invention because of their adaptibility to a variety of coating methods and their suitability to controlling the coating thicknesses employed.

The solution of coating composition must be applied to the self-supporting conductive substrate or supported conductive layer within the useful solution pot-life period, because coatings from solutions that have been pot-reacted tend to craze and separate from the substrate and vary unpredictably in their electrical properties. Pot-life is dependent upon the solids content of the solution. A solids content of up to about 40 percent by weight will result in a solution pot-life of up to about 4 hours at a temperature of about 20° C. At higher solids content, pot-life is likely to be reduced. Even when coated immediately after solution preparation, coatings formed from coating compositions having solids concentration near 40% have a greater tendency to flake and craze than do coatings having a lower level of solids concentration.

When tetraisopropyl titanate is employed in the coating composition, it has been found that the presence of isopropanol in the solution is useful for extending pot-life, reducing excessive foaming, and allowing a higher solids concentration. By adding from 5 to 10 percent by weight isopropanol based on the weight of total solvent pot-life can be extended from 4 hours to 7 days at 20° C., foaming can be reduced to a negligible level, and up to 60 percent by weight solids can be tolerated in the coating composition, a significant increase from the 40% solids level considered to be a maximum for providing 4 hour pot-life at 20° C.

Isopropanol can be substituted for up to 90 percent by weight of the solvent, e.g. isopropyl acetate, in the coating composition formulation without producing any observable deleterious effect. If isopropanol were to be substituted for the entire solvent, however, a cloudy solution would result.

Various methods can be employed to apply the dielectric coating to the conductive substrate. Useful methods include dip coating, spray coating, extrusion coating, and various methods of roll coating. The method of choice is dependant upon the form of the conductive substrate. When the conductive substrate is in the form of a solid cylinder, spray or dip coating may be employed advantageously, whereas when the conductive substrate is in form of a flexible, continuous sheet or web, extrusion coating is preferable because it permits continuous mass production.

After the dielectric coating composition has been applied to the conductive substrate, it should first be allowed to dry and air cure at room temperature, e.g., 20° C., for a period of about 4 to about 24 hours. Then, the dried coating is preferably post-cured. Electrical properties and durability properties of the recording member are affected by the cure to which the dielectric coating is subjected. Appropriate post-curing conditions are is selected according to the particular application for the recording member.

Various methods may be employed to post-cure the coatings of the present invention, including heat, exposure to ultraviolet radiation, and exposure to electron beam. If heat is used for post-curing, exposure to temperatures between about 90° C. and about 110° C. for periods of time from about 12 to about 16 hours will result in an adequate cure. Coating compositions containing titanium metal esters are curable by exposure to ultraviolet radiation. Coatings containing materials capable of undergoing free radical reactions such as reactive silanes containing an acrylate group, are curable by exposure to electron beam radiation.

The intensity of post-cure affects resistivity of the coating. More intensive post-curing will result in a coating having increased resistivity. Insufficient post-curing will result in a coating with reduced durability. The choice of post-curing conditions may also be dependant upon the properties of the substrate used to construct the recording member. For example, a polymeric film substrate might be distorted or lose physical properties at too high of a temperature, and a curing regime employing a longer time at a lower temperature would need to be employed to achieve the desired result.

Other dielectric coatings that are suitable for the recording member of the present invention include the coating described in U.S. Pat. No. 4,042,749, and in U.S. Pat. No. 4,049,861, both of which are incorporated herein by The coating described in U.S. Pat. No. 4,042,749, is similar to the preferred coating previously described, but it does not employ the optional organic epoxide co-reactant in the coating formulation.

The coating described in U.S. Pat. No. 4,049,861 is prepared from a polymer comprising at least 15 percent by weight of units from an epoxy-terminated silane represented by the formulae:

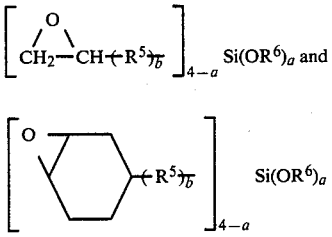

wherein each $R^5$ is independently a non-hydrolyzable divalent hydrocarbon radical of less than 20 carbon atoms, or a divalent radical of less than 20 carbon atoms the backbone of which is C atoms which may be interrupted by individual atoms for the group of N and O, the O atoms in the form of either linkages, a is 1, 2, or 3, b is 0, or 1, and $R^6$ is an aliphatic hydrocarbon radical of less than 10 carbon atoms, an acyl radical of less than 10 carbon atoms, or a radical of the formula $(CH_2CH_2O)_kZ$ in which k is an integer of at least 1, and Z is hydrogen or an aliphatic hydrocarbon radical of less than 10 carbon atom, cured in the presence of a catalytically active amount of a highly fluorinated sulfonylic catalyst comprising two highly fluorinated aliphatic sulfonyl groups attached directly to an imide or a methylene or highly fluorinated sulfonic catalyst comprising a highly fluorinated aliphatic sulfonic acid or salt thereof.

The disulfone catalysts work best on cationically polymerizable compounds, thus the other copolymerizable materials most useful are those in which the comonomer is capable of cationic polymerization such as styrene, methyl styrene, vinyl amides and vinyl ethers.

The best compounds, however, are the epoxy compounds such as 1,4-butanediol diglycidyl ether, diglycidyl ether of bisphenol A, and

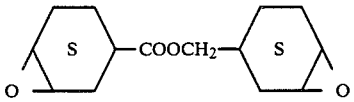

These compounds may be copolymerized with the epoxy terminated silane and a moisture sensitive compound containing Si, Al, Ti or Zr. In general all compounds that can be copolymerized with an epoxy or silane functionality are useful.

The conductive substrate can be formed of either a self-supporting conductive material or a layer of conductive material applied to a non-conductive supporting substrate such as, for example, a flexible belt made of a polymeric material, in which case, the recording member itself would be flexible. In an example of a self-supporting conductive material, as shown in FIG. 1, the conductive substrate can be a metal drum made of brass, aluminum, steel, or the like, having sufficient conductivity to fulfill the requirements of the electrical circuit of the recording system. The conductive substrate is in contact with ground to facilitate appropriate leakage of charge from the dielectric coating. Alternatively, a layer of conductive material can be applied to the surface of non-conductive supporting substrate, e.g. a polymeric film, in which case, the conductive layer occupies an intermediate position between the polymeric film and the dielectric coating. This embodiment is shown in FIG. 2.

Materials suitable for the conductive layer include metallic foils or sheets, such as aluminum or copper, metallic coatings such as gold, or metals deposited by one of a number of means such as vapor, sputtering, or plasma deposition, and conductive metal oxide films such as indium tin oxide, which can be deposited by a number of means.

The conductive layer is required to exhibit sufficient conductivity so as to transport charge at a rate consistent with the desired application. It has been found that conductive layers exhibiting resistivity less than 5000 ohms per square are generally useful in most applications.

It is preferred that the conductivity of the conductive layer not decrease below the desired level with time or with exposure of the recording member to changing environmental conditions such as exposure to high or to low relative humidity.

In situations wherein visual display or optical projection of the toner image is contemplated, and the dielectric layer is transparent, the conductive layer should also exhibit the appropriate degree of transparency, reflectivity, or opacity for the desired effect.

When visual display or optical projection of the reflected toner image is contemplated, it is preferred that the recording member produce a non-specular rather than specular reflection. A non-specular background to the image simplifies the arrangement of optical elements used when optical projection is considered.

It is often preferred that the non-conductive supporting substrate of the recording member be a flexible polymeric film. The film is relatively inexpensive, it is easily coatable, and the resulting product can be converted into various shapes and sizes, e.g. an endless belt for use in an electrographic recording system.

The polymeric film can be any material that has sufficient stability to undergo the processing steps required to fabricate the recording member and to function with acceptable durability and stability in the electrographic recording system. Among polymeric materials suitable for forming the polymeric film are polyesters, polyolefins, polyamides, polyimides and vinyls. Polyester films are preferred because they can be produced with smooth surfaces, are resistant to attack from solvents, are resistant to heat distortion, and have good physical properties such as good tensile strength. Representative examples of commercially available polyester films are various grades of Scotchpar® manufactured by Minnesota Mining and Manufacturing Company, various grades of Mylar® manufactured by DuPont de Nemours Corporation, and various grades of Melinex® manufactured by ICI.

Figure 3:
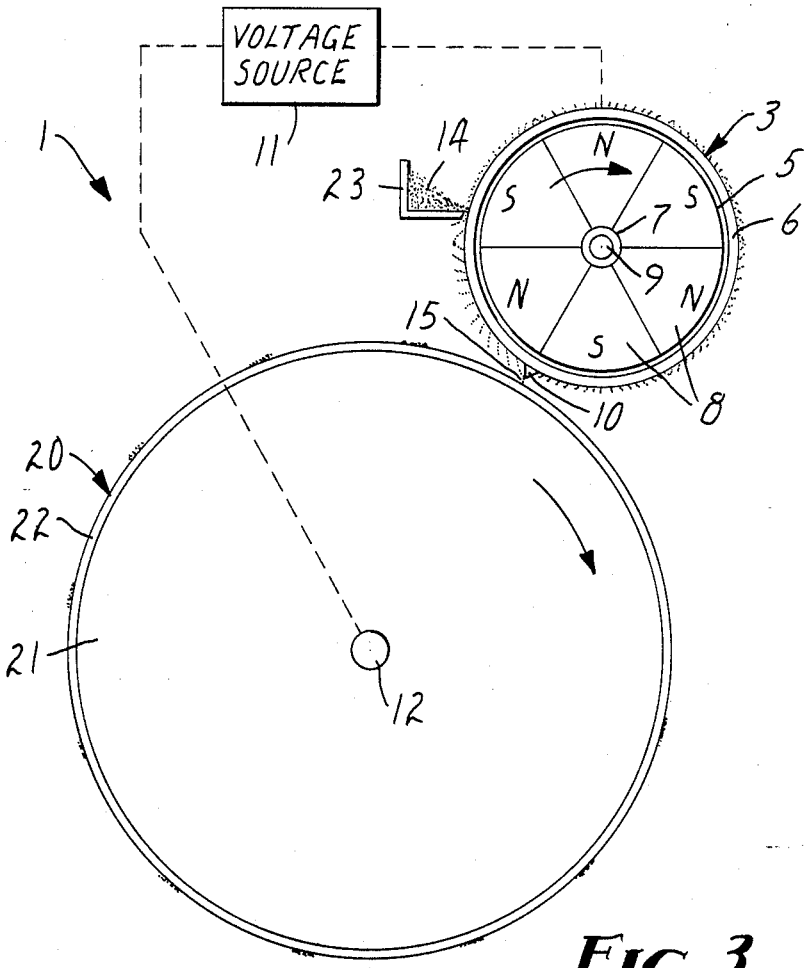
FIG. 3 is an end view of an electrographic recording system incorporation the recording member of the present invention.

Referring now to the drawings (and with specific reference first to FIG. 3) a recording system 1 employing the dielectric recording member of the present invention is shown. The recording system 1 includes a cylindrical developer roll 3 and a rotatable recording member 20.

The developer roll 3 preferably is of the type such as disclosed in Anderson, U.S. Pat. No. 3,455,276, and has an inner magnet assembly 5 and an outer cylindrical shell 6 that is electrically nonconductive and nonmagnetic. The magnet assembly 5 includes a cylindrical, magnet support core 7 and a plurality of permanent magnet sectors 8 arranged about the cylindrical periphery of the core 7 to define a surface having alternate North and South magnetic poles. The developer roll 3 is mounted on an axle 9 and is constructed such that the magnet assembly 5 rotates in a clockwise direction, whereas the outer shell 6 is spaced from the magnet assembly 5 and is preferably fixed in position.

Arranged on a line that extends parallel with the support core 7 are a plurality of individual, spaced apart recording electrodes 10 (only one of which is shown) that protrude from the periphery of the shell 6, but may also be disposed in the shell 6 so that the outer ends of the electrodes 10 are flush with the periphery of the shell 6.

Each electrode 10 is magnetically permeable and passes a large amount of magnetic flux emanating from the magnet sectors 8 of the developer roll 3 so that the developer roll 3 serves as a force means for providing a relatively high magnetic flux density at the outer ends of the electrodes 10. Each electrode 10 is used to print a dot that has a definition defined by its shape, density and distribution of density, and the electrodes 10 are normally utilized to serve as a printing matrix. The number of electrodes 10 employed is dependent upon the printing application for which the matrix is to be used. In the case of a standard computer output line width of one hundred thirty-six, 5×7 dot matrix characters, nearly 1000 electrodes are employed, spaced at 70/inch. For more complex character fonts and simple graphic applications, electrode spacings of 100/inch to over 400/inch are required. A voltage source 11 supplies record voltage potential pulses to the electrodes 10 in a manner and for a purpose as will be described below.

The recording member 20 is mounted on an axle 12 that is parallel to the developer roll 3 and is rotatably driven clockwise to rotate in the same direction as the developer roll magnet assembly 5. The member 20 is positioned in a spaced relationship with the electrodes 10 to define a narrow recording region 13 therebetween. Forming the member 20 are an electrically conductive cylindrical electrode 21 and an endless dielectric coating 22 that overlies the cylindrical surface of the electrode 21. Preferably, the electrode 21 is electrically grounded.

The voltage source 11 serves to provide voltage record pulses to the electrodes 10 to produce a potential difference between the electrodes 10 and the grounded electrode 13. Such potential difference results in toner deposition on the dielectric coating 22. The electrodes 10 are selectively pulsed by the source 11 to form toner images on the surface of the coating 22. The portion of the toner 14 that is deposited on the coating 22 in the form of toner images initially has a relatively high charge and is held on the coating 22 by the potential difference between the charged toner 14 and the grounded electrode 21.

The toner is preferably magnetically attractable and electronically conductive. A toner suitable for the apparatus described is disclosed in Nelson, U.S. Pat. No. 3,639,245.

A layer of magnetically attractable, electronically conducting toner 14 is metered onto the surface of electrode 10 by a doctor blade 23 which is extended in an axial direction but at a fixed space from electrode 10. The toner 14 is held and attracted to electrode 10 by the magnetic field exerted by magnet sectors 8. In this embodiment the magnet assembly 5 is arranged to rotate in a clockwise manner around its axis thus maintaining an effectively constant supply of toner 14 throughout the surface of electrode 10. Rotation of the magnet sectors 8 alone or together with the electrode 10 in either direction may also be done. A suitable developer roll of the type described is disclosed in Anderson, U.S. Pat. No. 3,455,276.

The following examples are meant to illustrate, but not limit this invention. Parts and percentages are by weight unless otherwise indicated.

EXAMPLE 1

The following ingredients, in the amounts, indicated, were used to prepare a composition for the surface coating of the recording member:

| Ingredient | Amount |
|---|---|
| γ-glycidoxypropyltrimethoxysilane ("A187", Union Carbide) | 4.3 g |
| γ-aminopropyltriethoxysilane ("A1100 Silane", Union Carbide) | 1.0 g |
| Diglycidyl ether-Bisphenol A type epoxide (50% DuPont Epon 828 in isopropyl acetate) | 1.6 g |
| Tetraisopropyl titanate (Dupont TPT Titanate) | 1.6 g |
| Fluorochemical-based surfactant (10% 3M FC430 in isopropanol) | 0.04 g |
| Isopropyl acetate | 30.0 g |

The silanes, the aromatic epoxide, and the leveling agent were introduced into the isopropyl acetate solvent. The solution was agitated gently to combine the ingredients without generating excessive foam. The tetraisopropyl titanate was added last to minimize premature pot reaction. After addition of tetraisopropyl titanate, the solution, which had a useful pot-life of approximately 4 hours at 20° C., was coated onto an aluminum sheet by means of dip coating. Prior to the coating, the aluminum sheet had been (1) degreased in methylene chloride vapors; (2) etched for 30 seconds in a solution comprising 1 part concentrated nitric acid, 1.6 parts 85% phosphoric acid and 10.3 parts deionized water; (3) rinsed with deionized water; and (4) dried with filtered air. The prepared aluminum sheet was submerged in the coating solution, then withdrawn at a rate to produce a dried coating thickness of 0.9 micrometers. The coating was allowed to dry and cure at about 20° C. for about 16 hours. The coating was then post-cured in an oven for about 16 hours at about 90° C.

The resistivity of the dielectric recording member exceeded $10^7$ ohm-centimeters. When operated in an apparatus such as that described in U.S. Pat. No. 3,816,840, the recording member was capable of providing up to 200,000 cycles of image formation and removal. Of course the dielectric coating was capable of withstanding more than 50 cycles when subjected to a 500 gram load in accordance with the procedure of ASTM D-1044 (1982).

EXAMPLE 2

The following ingredients, in the amounts indicated, were used to prepare a composition for the surface coating of the recording member:

| Ingredient | Amount |
|---|---|
| γ-glycidoxypropyl trimethoxy silane ("A187", Union Carbide) | 4.3 g |
| γ-aminopropyl triethoxy silane ("A1100" Silane, Union Carbide) | 1.0 g |
| Diglycidyl ether-Bisphenol A type epoxide (50% DuPont Epon 828 in isopropyl acetate) | 1.6 g |
| Tetraisopropyl titanate (DuPont TPT Titanate) | 1.6 g |
| Isopropyl alcohol | 3.0 g |
| Isopropyl acetate | 27.0 g |

The silanes and the aromatic epoxide were introduced with stirring into a solvent mixture comprising 27.0 g of isopropyl acetate and 1.5 g of isopropyl alcohol. The tetraisopropyl titanate was first mixed with 1.5 g of isopropyl alcohol, and this mixture was then introduced into the mixture of solvents, silanes, and aromatic epoxide. The solution, which had a pot-life of approximately 7 days at 20° C., was coated onto a conductive substrate by means of dip coating. The conductive substrate was white polyester film, 50.8 micrometers thick, coated on one surface with a transparent layer of indium tin oxide sufficient to provide a resistivity of less than 500 ohms per square wrapped around and secured to a steel cylinder with the polyester film between the indium tin oxide layer and the steel cylinder.

The assembly of the steel cylinder wrapped with the indium tin oxide-coated white polyester film was submerged in the solution, then withdrawn at a rate to produce a dried coating thickness of 0.69 micrometers. The coating was allowed to dry and cure at about 20° C. for about 16 hours. The coating was then post-cured in an oven for about 16 hours at about 90° C.

The resistivity of the dielectric recording member exceeded $10^7$ ohm-centimeters. When operated in an apparatus such as that described in U.S. Pat. No. 3,816,840, the recording member was capable of providing up to 200,000 cycles of image formation and removal. As in Example 1, the dielectric coating was capable of withstanding more than 50 cycles when subjected to a 500 gram load in accordance with the procedure of ASTM D-1044 (1982).

Various modifications and alterations of this invention will become apparent to those skilled in the art without departing from the scope and spirit of this invention and it should be understood that this invention is not to be unduly limited to the illustrative embodiments set forth herein.

What is claimed is:

1. A recording member suitable for use in an electrographic recording system for recording toner images on a recording member, said system including first and second opposed electrodes spaced apart to define a recording region therebetween, means for driving the recording member through said recording region, and a means for transporting electrically conductive toner powder from a toner reservoir to said recording region to selectively deposit on said recording member in response to the selective application of voltage pulses across said electrodes, said recording member comprising a conductive substrate bearing a dielectric coating formed from the reaction product of a composition comprising (a) a reactive silane of the formula $R_n^1$—Si—$R_{4-m}^2$, wherein $R^1$ is selected from the group consisting of $CH_2$=CH—, an alkyl group of from 2 to 10 carbon atoms containing an epoxy group, an alkyl ether epoxide group containing up to 10 carbon atoms, and

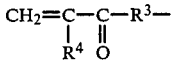

wherein $R^3$ is an alkylene group having from 1 to 8 carbon atoms, and $R^4$ is hydrogen or an alkyl radical having from 1 to 8 carbon atoms; $R^2$ is an alkoxy or acetoxy group, n is a positive integer of 1 to 3; and (b) a metal ester of the formula $M(OR)_x$, wherein M is selected from the group consisting of titanium, aluminum, and zirconium; R is an alkyl radical having from 1 to 8 carbon atoms, and x is equal to the number of valence bonds of M, said dielectric coating having sufficient abrasion resistance to withstand at least 50 cycles when subjected to 500 grams load in accordance with ASTM D-1044 (1982) before the percentage of light scattered does not change with additional cycles, and having an electronic resistivity of at least $10^7$ ohms-centimeters.

2. A recording member according to claim 1 wherein said member is sufficiently low in optical density so that the constrast between said recording member and said toner is at least 0.6 optical density units.

3. A recording member according to claim 1 wherein said conductive substrate is made from a conductive metal.

4. A recording member according to claim 1 wherein said conductive substrate comprises a conductive layer supported by a non-conductive insulating substrate.

5. A recording member according to claim 1 wherein said metal ester is selected from the group $Ti(OR)_4$ and $Al(OR)_3$ and said silane is selected from the group gamma-glycidoxypropyltrimethoxysilane and gamma-methacryloxypropyltrimethoxysilane.

6. A recording member according to claim 1 wherein said metal ester is $Ti(OR)_4$ and said silane is gamma-glycidoxypropyltrimethoxysilane.

7. A recording member according to claim 1 wherein said metal ester is tetraisopropyl titanate.

8. A recording member according to claim 1 wherein the mole ratio of said metal ester to said silane is from about 1:0.5 to about 1:7.

9. A recording member according to claim 1 wherein said composition further includes an epoxide containing only carbon, hydrogen, oxygen and nitrogen, wherein the weight ratio of said epoxide to said reactive silane is from about 10:90 to 25:75 and wherein said epoxide is selected from diglycidyl ethers of polyhydricphenols, glycidyl ethers of novolak resins, glycidyl ethers of aliphatic polyols and glycidyl ethers containing nitrogen.

10. A recording member according to claim 9 wherein said epoxide comprises a diglycidyl ether of a polyhydric phenol.

11. A recording member according to claim 9 wherein said diglycidyl ether of a polyhydric phenol comprises the condensation product of epichlorohydrin and Bisphenol A.

12. A recording member suitable for use in an electrographic recording system for recording toner images on a recording member, said system including first and second opposed electrodes spaced apart to define a recording region therebetween, means for driving the recording member through said recording region, and a means for transporting electrically conductive toner powder from a toner reservoir to said recording region to selectively deposit on said recording member in response to the selective application of voltage pulses across said electrodes, said recording member comprising a conductive substrate bearing a dielectric coating wherein said dielectric coating is a polymer comprising at least 15 percent by weight of units from an epoxy-terminated silane represented by the formulae:

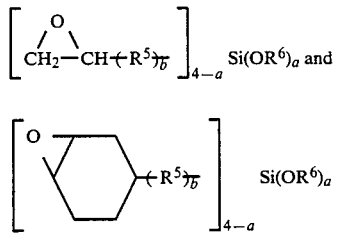

wherein each $R^5$ is independently a non-hydrolyzable divalent hydrocarbon radical of less than 20 carbon atoms, or a divalent radical of less than 20 carbon atoms the backbone of which is O atoms which may be interrupted by individual atoms from the group of N and O the O atoms in the form of ether linkages, a is 1, 2, or 3, b is 0, or 1, and $R^6$ is an aliphatic hydrocarbon radical of less than 10 carbon atoms, an acyl radical of less than 10 carbon atoms, or a radical of the formula $(CH_2CH_2O)_kZ$ in which k is an integer of at least 1, and Z is hydrogen or an aliphatic hydrocarbon radical of less than 10 carbon atom, cured in the presence of a catalytically active amount of a highly fluorinated sulfonylic catalyst comprising two highly fluorinated aliphatic sulfonyl groupd attached directly to an imide or a methylene or highly fluorinated sulfonic catalyst comprising a highly fluorinated aliphatic sulfonic acid or salt thereof, said dielectric coating having sufficient abrasion resistance to withstand at least 50 cycles when subjected to 500 grams load in accordance with ASTM D-1044 (1982) before the percentage of light scattered does not change with additional cycles, and having an electronic resistivity of at least $10^7$ ohms-centimeters.

13. A recording member according to claim 1 wherein said electrically conductive substrate is transparent to visible light.

14. A recording member according to claim 1 wherein said dielectric coating is transparent to visible light.

15. A recording member according to claim 1 wherein the thickness of said dielectric coating is from about 0.3 micrometers to about 3.0 micrometers.

16. A recording member according to claim 1 wherein said recording member is flexible.

* * * * *

UNITED STATES PATENT AND TRADEMARK OFFICE

CERTIFICATE OF CORRECTION

PATENT NO. : 4,666,780

DATED : May 19, 1987

INVENTOR(S) : James L. Krum

It is certified that error appears in the above-identified patent and that said Letters Patent is hereby corrected as shown below:

Col. 10, line 22, "herein by" should read --herein by reference.--

Col. 15, line 24, "$R_4-_m{}^2$" should read --$R_4-_n{}^2$--

Col. 16, line 51, "which is O atoms" should read --which is C atoms"

Col. 16, line 53, "N and O the" should read --N and O, the--

Col. 16, line 64, "groupd" should read --groups--

Signed and Sealed this

Thirteenth Day of October, 1987

*Attest:*

DONALD J. QUIGG

*Attesting Officer*

*Commissioner of Patents and Trademarks*